US007802784B2

(12) United States Patent
Yamamoto

(10) Patent No.: US 7,802,784 B2
(45) Date of Patent: Sep. 28, 2010

(54) SHEET FEEDING APPARATUS AND IMAGE READING APPARATUS

(75) Inventor: Yuichi Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/395,789

(22) Filed: Mar. 2, 2009

(65) Prior Publication Data

US 2009/0224462 A1 Sep. 10, 2009

(30) Foreign Application Priority Data

Mar. 7, 2008 (JP) ..... 2008-058497

(51) Int. Cl.
*B65H 3/06* (2006.01)

(52) U.S. Cl. ..... 271/117; 271/118; 271/111; 271/126

(58) Field of Classification Search ..... 271/118, 271/117, 110, 111, 126
See application file for complete search history.

(56) References Cited

U.S. PATENT DOCUMENTS 4,787,616 A 11/1988 Sasaki et al. ..... 271/3.1
4,823,159 A 4/1989 Yamamoto et al. ..... 355/3 SH
5,462,267 A * 10/1995 Hori ..... 271/10.04
6,091,927 A 7/2000 Hattori et al. ..... 399/367
6,131,898 A * 10/2000 Hiroi et al. ..... 271/10.03
6,299,156 B1 * 10/2001 Kaneda et al. ..... 271/117
6,493,113 B1 * 12/2002 Fujii et al. ..... 358/488
6,554,270 B2 4/2003 Yamamoto ..... 271/117
6,565,077 B2 * 5/2003 Kawada ..... 271/10.03
7,000,915 B2 2/2006 Makino ..... 271/3.14

FOREIGN PATENT DOCUMENTS

JP 3560803 9/2004
JP 3747986 2/2006

* cited by examiner

*Primary Examiner*—David H Bollinger
(74) *Attorney, Agent, or Firm*—Fitzpatrick, Cella, Harper & Scinto

(57) ABSTRACT

A sheet feeding apparatus has a liftable stacking member on which a sheet is stacked, a feeding member which feeds the sheet in abutment against the uppermost one of the sheets placed on the stacking member, the feeding member moving from a separation position to an abutment position, a driving portion which lifts the stacking member, a sensor to detect that an uppermost sheet is below a predetermined position, and a control portion configured to control the driving portion so as to lift the stacking member when a signal from the sensor is received in sequence a plurality of times, which the control portion receives from a sensor due to the feeding member moving from the separation position to the abutment position repeatedly, indicate that the uppermost one of the sheets placed on the stacking member is located below a predetermined position.

7 Claims, 9 Drawing Sheets

SHEET FEEDING APPARATUS AND IMAGE READING APPARATUS

BACKGROUND OF THE INVENTION

1. Field of the Invention

The present invention relates to a sheet feeding apparatus and an image reading apparatus and, more particular, to positional control of a sheet stacking member which can be lifted or lowered.

2. Description of the Related Art

Conventionally, an image reading apparatus such as a scanner, an image forming apparatus such as a printer or a facsimile, or a composite machine having the functions thereof in combination has been provided with a sheet feeding apparatus which feeds a sheet such as an original or a recording sheet to an image reading portion or an image forming portion. For example, a conventional image reading apparatus includes a liftable sheet stacking member, on which a sheet-like original is placed, original feeding unit, and a sheet feeding apparatus which feeds an original stacked on the sheet stacking member to an image reading portion by the original feeding unit (See Patent Document 1: Japanese Patent No. 3747986; and Patent Document 2: Japanese Patent No. 3560803).

The conventional sheet feeding apparatus includes a detecting unit which detects whether or not a sheet stacked on the sheet stacking member reaches a sheet feed position, so as to control lifting of the sheet stacking member based on a result detected by the detecting unit. This control enables the sheet feed position to be constantly maintained irrespective of the number of sheets set on the sheet stacking member, thereby stabilizing a sheet feeding operation.

By way of an example of the positional control of the sheet stacking member, if it is detected that an uppermost sheet stacked on the sheet stacking member has not reached the sheet feed position, the sheet stacking member is lifted by a predetermined amount. Here, the detection of the position of the sheet feeding unit which is contacting to the uppermost sheet allows detection as to whether or not the sheet stacked on the sheet stacking member reaches the sheet feed position.

By way of another example, if it is detected that the uppermost sheet does not reach the sheet feed position, the sheet feeding operation is temporarily brought to a halt, and then, the sheet stacking member is lifted until it is detected that the sheet stacked on the sheet stacking member reaches the sheet feed position.

However, in the sheet feeding apparatus, the image reading apparatus, and the image forming apparatus in the prior art, the position of the sheet feeding unit may be fluctuated by an adverse influence of vibrations of the apparatus, a curl, a fold, a crease of the sheet, or a deformation of a roller provided with the feeding unit, or the like. When the position of the sheet feeding unit is fluctuated, a sensor which detects the position of the sheet feeding unit erroneously detects the position of the sheet feeding unit.

In this manner, if the position of the sheet feeding unit is erroneously detected, the sheet stacking member may be lifted farther by a predetermined amount from the erroneously detected position in the case where the position of the sheet stacking member is controlled by detecting the position of the sheet feeding unit. As a consequence, the sheet may be brought into press-contact with the sheet feeding unit, thereby possibly making it difficult to feed the sheet.

In order to solve the above-described problem, it has been proposed that there is provided, for example, an upper limit detecting sensor or an abutment which restricts the movement of the sheet feeding unit by a torque limiter, such that the sheet feeding unit cannot be moved upward beyond the correct sheet feed position. However, if such an upper limit detecting sensor or the like is provided, the apparatus may be increased in size and cost.

In the meantime, in the case where the position of the sheet stacking member is controlled based on the position of the uppermost sheet stacked on the sheet stacking member, the sensor may erroneously detect due to the vibrations of the apparatus that the uppermost sheet does not reach the sheet feed position irrespective of the reach of the uppermost sheet up to the sheet feed position.

Even in the case of such an erroneous detection, the sheet stacking member is lifted. At this time, the feeding operation must be temporarily brought to a halt during lifting of the sheet stacking member. In other words, if the sensor erroneously detects the position, the sheet stacking member may be unnecessarily lifted with a temporary halt of the feeding operation, thereby reducing productivity.

In order to solve the above-described problems, there has been proposed a configuration in which a sensor for detecting that the uppermost sheet reaches the sheet feed position is located at a position apart from the sheet feeding portion and irrelevant to the sheet feeding operation, so as to prevent any halt of the sheet feeding operation.

However, in this case, the sensor may not accurately detect the position of the upper surface of the sheet by the influence of the status of the sheet such as an end float caused by the curl, so that the sheet may not be properly fed. Here, there is provided sheet pressing unit in such a manner as to prevent any influence of the status of the sheet such as the end float caused by the curl, thereby inducing an increase in size and cost of the apparatus.

The present invention has been made in view of such circumstances and provides a sheet feeding apparatus which can stably feed a sheet and prevent any degradation of productivity, an image reading apparatus, and an image forming apparatus.

SUMMARY OF THE INVENTION

A sheet feeding apparatus according to the present invention includes: a liftable stacking member, on which a sheet is stacked; a feeding member which feeds the sheet in abutment against the uppermost one of the sheets placed on the stacking member, wherein the feeding member moves from a separation position, at which the feeding member is separated from the uppermost one of the sheets placed on the stacking member, to an abutment position at which the feeding member abuts against the uppermost one of the sheets placed on the stacking member, and after the feeding member feed the uppermost one of the sheets placed on the stacking member, the feeding member moves from the abutment position to the separation position; a driving portion which lifts the stacking member; a sensor which generate a signal indicating the uppermost one of the sheets that the feeding member abuts against is below a predetermined position; and a control portion configured to controls the driving portion so as to lift the stacking member when the signal is received in sequence a plurality of times, which the control portion receives from the sensor due to the feeding member moving from the separation position to the abutment position repeatedly, indicate that the uppermost one of the sheets placed on the stacking member is located below a predetermined position.

According to the present invention, the sheet can be stably fed by lifting the stacking member in response to the receptions of a signal indicating that the uppermost sheet is under the predetermined position a plurality of times from the sensor.

Further features of the present invention will become apparent from the following description of exemplary embodiments (with reference to the attached drawings).

DESCRIPTION OF THE EMBODIMENTS

An exemplary embodiment carrying out the present invention will be described in detail below with reference to the attached drawings.

Figure 1:
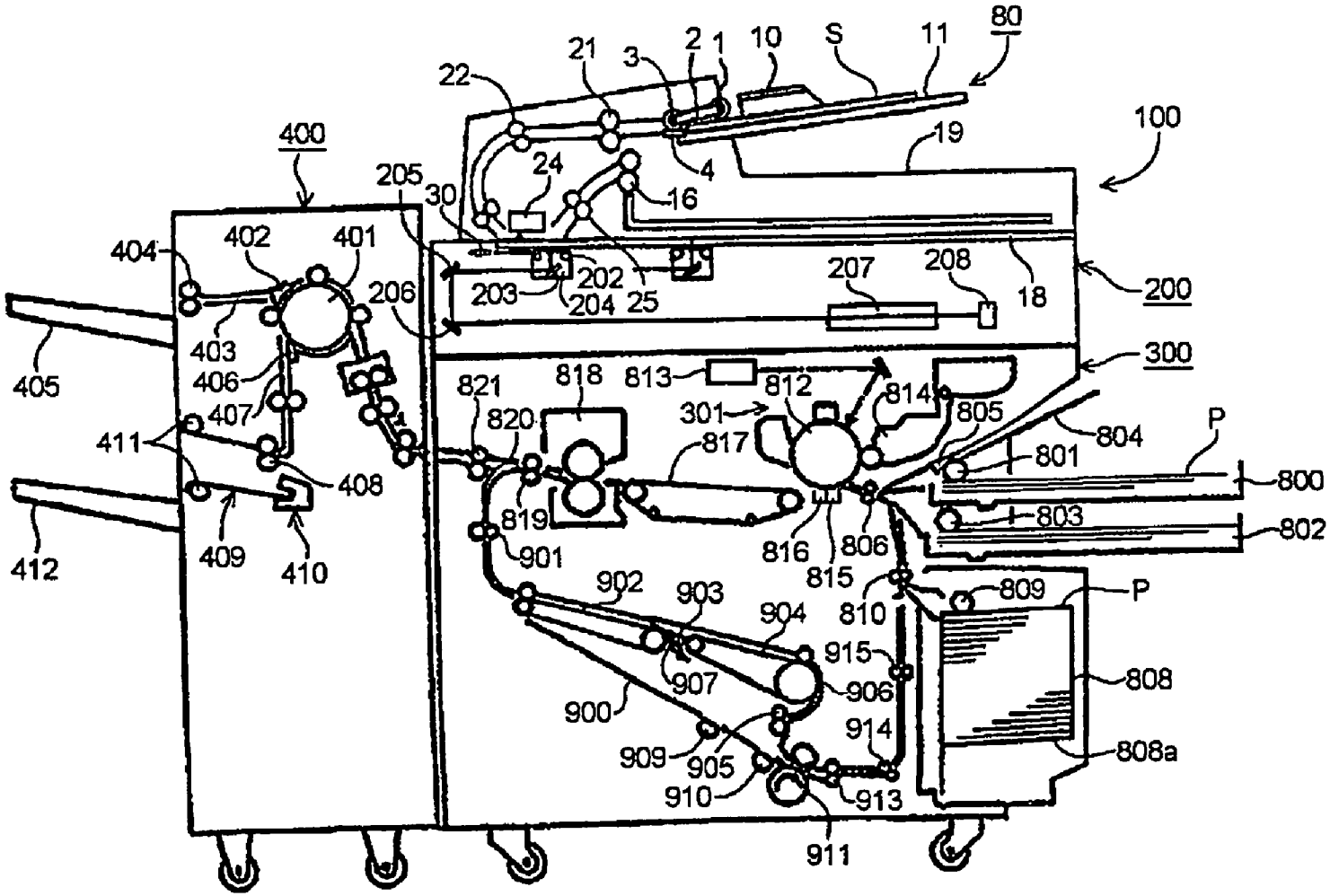
FIG. 1 is a view illustrating the configuration of a copying machine which is an example of an image forming apparatus including an image reading apparatus provided with a sheet feeding apparatus according to an embodiment of the present invention.

FIG. 1 is a view illustrating the configuration of a copying machine which is an example of an image forming apparatus including an image reading apparatus provided with a sheet feeding apparatus according to an embodiment of the present invention. In FIG. 1, a copying machine 100 is configured of an image reading apparatus body 200 and a copying machine body 300.

The image reading apparatus body 200 includes an ADF 80 serving as an original feeding apparatus which is an example of a sheet feeding apparatus in the upper section thereof. In the meantime, the copying machine body 300 includes a sheet processing apparatus 400 sideways thereof. The image reading apparatus body 200 and the ADF 80 will be described later.

The copying machine body 300 further includes an upper cassette 800 and a lower cassette 802 containing sheets P serving as recording material therein, a manual guide 804, and a sheet deck 808 provided with an inner plate 808*a* to be lifted or lowered by a motor or the like.

The sheets P contained in the upper cassette 800 and the lower cassette 802 are separately fed one by one by feed rollers 801 and 803 and separation claws, not illustrated, respectively, to be then guided to registration rollers 806. Likewise, sheets stacked on the manual guide 804 are guided to the registration rollers 806 one by one via a pair of feed rollers 805. Sheets P stacked on and contained in the inner plate 808*a* of the sheet deck 808 are separately fed one by one by a feed roller 809 and a separation claw, not illustrated, to be then guided to the registration rollers 806 through conveying rollers 810.

The copying machine body 300 further includes an image forming portion 301 which forms an image on the fed sheet P. Here, the image forming portion 301 includes a photosensitive drum 812, and an optical system 813, a development device 814, a transfer charger 815, and a separating charger 816 which are arranged around the photosensitive drum 812.

The optical system 813 irradiates the surface of the photosensitive drum 812, which has been uniformly charged, with a laser beam according to an image of one piece of original read in the image reading apparatus body 200, thereby forming an electrostatic latent image on the photosensitive drum 812. Thereafter, the development device 814 develops the electrostatic latent image formed on the photosensitive drum 812 with a toner, thereby forming a toner image on the photosensitive drum 812.

The sheets Pin the number of pieces of originals to be copied are fed from either one of the cassettes 800 and 802 every formation of the image on the photosensitive drum 812. After that, the sheets P are registered with the photosensitive drum 812 by the registration rollers 806, to be then conveyed to a transferring portion configured of the photosensitive drum 812 and the transfer charger 815.

While the sheet P passes the transferring portion, the toner image formed on the photosensitive drum 812 is transferred onto the sheet by the transfer charger 815. Here, the sheet having the toner image transferred thereonto is peeled from the photosensitive drum 812 by the separating charger 816, and then, is fed to a fixing device 818 via a conveying belt 817. Thus, the fixing device 818 fixes the toner image onto the sheet by the application of heat and pressure.

Next, the sheet passing through the fixing device 818 is guided to a switching member 820 via conveying rollers 819, and then, is fed to an intermediate tray 900 via discharge rollers 821 or is discharged onto the sheet processing apparatus 400.

Here, the intermediate tray 900 is adapted to feed the sheet again, and therefore, the sheet having the image formed once thereon is stacked on the intermediate tray 900 in the case where images are formed on both sides of the sheet (duplex recording) or images are formed on either side of the sheet in superimposition (multiple recording).

The intermediate tray 900 includes conveying rollers 901, a conveying belt 902, a switching member 903, another conveying belt 904, and another conveying rollers 905. The sheet is guided onto the intermediate tray 900 along a path 906 in the case of the duplex recording, while the sheet is guided onto the intermediate tray 900 along another path 907 in the case of the multiple recording.

In this manner, the sheets placed on the intermediate tray 900 are separated one by one from the lowermost sheet and fed once more by the function of auxiliary rollers 909 and 910 and a pair of forward and reverse separating rollers 911. The sheet fed once more is guided to the transferring portion through the conveying rollers 913, 914, and 915, and the conveying rollers 810, and the registration rollers 806, and then, has toner images transferred thereon. After the transfer of the toner images, the toner images are fixed by the fixing device 818, and then, the sheet is discharged to the sheet processing apparatus 400.

The sheet processing apparatus 400 is designed to process the sheet discharged from the copying machine body 300 in either of a non-sort mode and a sort mode. When the non-sort mode is selected in the sheet processing apparatus 400, the sheets are discharged to and stacked on a sample tray 405 by discharge rollers 404 through a buffer roller 401, a switching member 402, and a non-sort mode path 403.

In contrast, when the sort mode is selected, the sheets are discharged to and temporarily stacked on a processing tray 409 by discharge rollers 408 through the buffer roller 401, a switching member 406, and a sort mode path 407. A sheet bundle stacked on the processing tray 409 are aligned at both ends in a direction crossing a sheet conveying direction by an aligning member, not illustrated. Moreover, the sheets are stapled at the trailing ends thereof by a stapler 410, as required. Thereafter, the sheet bundle stacked on the processing tray 409 is discharged to and stacked on a stack tray 412 by a pair of bundle discharge rollers 411.

Figure 2:
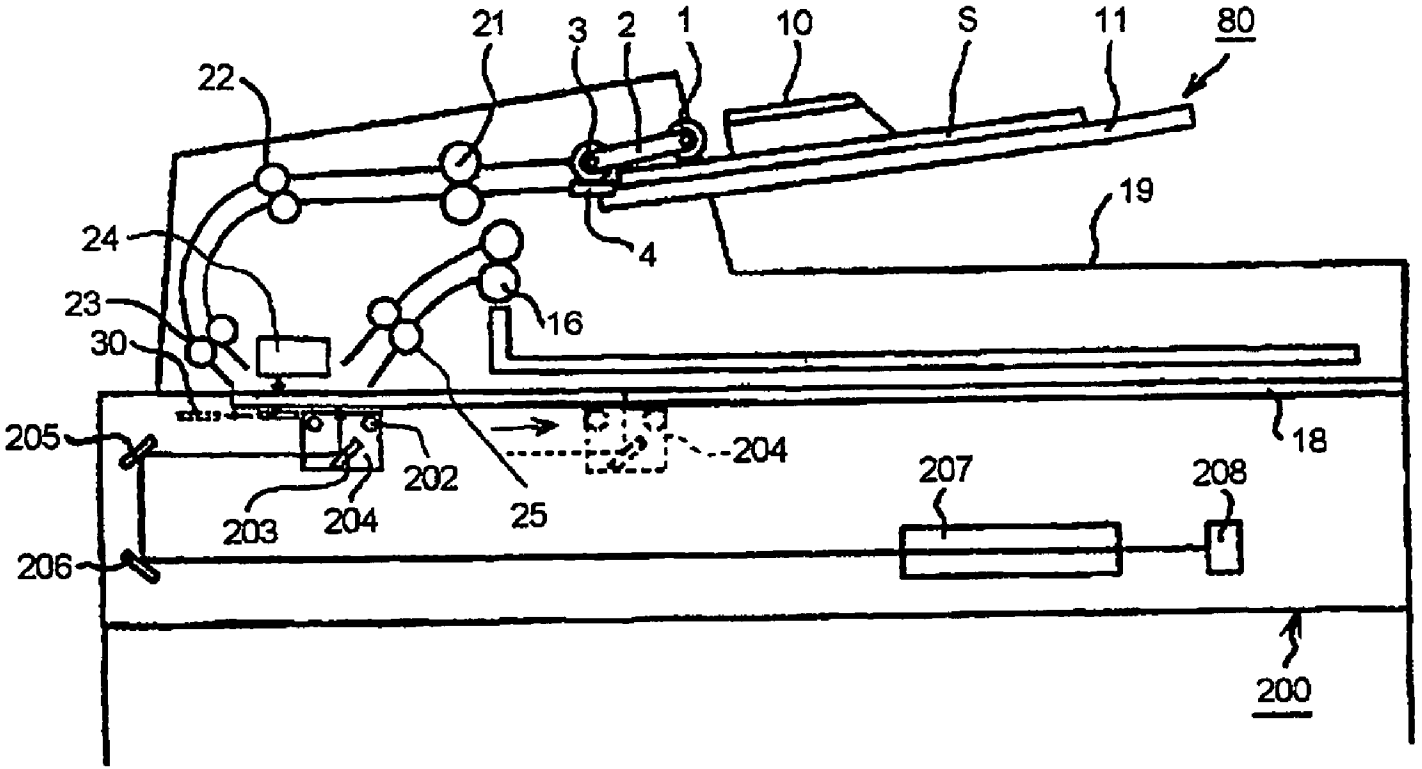
FIG. 2 is a view illustrating the configuration of the image reading apparatus.

FIG. 2 is a view illustrating the configuration of the image reading apparatus body 200. The image reading apparatus body 200 includes the ADF 80. The ADF 80 is adapted to convey (i.e., feed) originals S one by one onto a platen glass 18 such as a transparent glass. The ADF 80 is configured in such a manner as to be freely opened or closed with respect to the image reading apparatus body 200, and thus, it functions to press the original placed on the platen glass 18.

The image reading apparatus body 200 is designed to optically read an image of the original conveyed by the ADF 80 or placed on the platen glass 18, and then, to optoelectronically transduce it into image information, thereby inputting it into (the optical system 813 of) the copying machine body 300.

The image reading apparatus body 200 includes a contact image sensor 24 serving as first image reading unit which reads the image of the original conveyed on the platen glass 18, so as to read the image of the original. The contact image sensor 24 is secured at a predetermined position on a side of the ADF 80, to thus read the image on either side of the original conveyed on the platen glass 18.

The image reading apparatus body 200 further includes second image reading unit configured of a movable scanner unit 204 having a lamp 202 and a mirror 203, mirrors 205 and 206, a lens 207, and an image sensor 208.

The second image reading unit is designed to stop the scanner unit 204 at a predetermined position indicated by a solid line, so as to read an image on the other side of the original conveyed on the platen glass 18 by the ADF 80. In addition, the second image reading unit is adapted to read the image on the other side of the original placed on the platen glass 18 while moving the scanner unit 204 in a direction indicated by an arrow along the platen glass 18.

Moreover, the image reading apparatus body 200 includes an image offset preventing member 30 serving as image offset preventing unit which prevents any offset of an image of an original at a position facing the contact image sensor 24. The image offset preventing member 30 is provided movably from a first position indicated by the solid line, at which it faces the contact image sensor 24, to a second position indicated by a broken line, at which it cannot prevent the image from being read accompanied with the movement of the scanner unit 204. The image offset preventing member 30 is disposed on the side of the scanner unit 204, at which it faces the contact image sensor 24 via the platen glass 18.

In the meantime, the ADF 80 includes, in the upper section thereof, an original tray 11 serving as a sheet stacking member capable of being lifted or lowered between an original set position (i.e., a sheet set position), at which the original such as the sheet is set, and an original feed position (i.e., a feed position), at which the original can be fed. The originals S stacked on the original tray 11 are fed sequentially from an uppermost one to an image read position by the first and second image reading unit by a feed roller 1 serving as a rotary feeding member.

Here, the original feed position signifies an ideal position (i.e., a range) in a height direction of the upper surface of the original when the original stacked on the original tray 11 is fed by the feed roller 1. Even if the uppermost original is positioned slightly downward of the range, about three originals, for example, may be fed.

The originals S fed by the feed roller 1 are separately conveyed one by one by a separation roller 3 and a separation pad 4. Skew feeding of the original S separately conveyed is corrected by registration rollers 21, and then, the original S is turned around and conveyed by conveying rollers 22, 23, and 25. Here, the conveying rollers 23 and 25 located around the reading portion including the contact image sensor 24 and the scanner unit 204 are set at a constant speed, so as to eliminate a difference in conveyance speed of the original S.

Thereafter, the image of the original S is read by either or both of the scanner unit 204 and the contact image sensor 24 when the original S, which is conveyed at the constant speed by the conveying rollers 23 and 25, passes on the platen glass 18. And then, the original S whose image has been read is discharged onto a discharge tray 19 by discharge rollers 16.

Here, an original width restricting plate 10 which restricts a widthwise direction of the stacked original S is disposed on the original tray 11. The original tray 11 is configured in such a manner as to be freely lifted or lowered on a rotational center, not illustrated, by an original tray lifting and lowering motor (driving portion) M2 illustrated later in FIG. 5.

Figure 3:
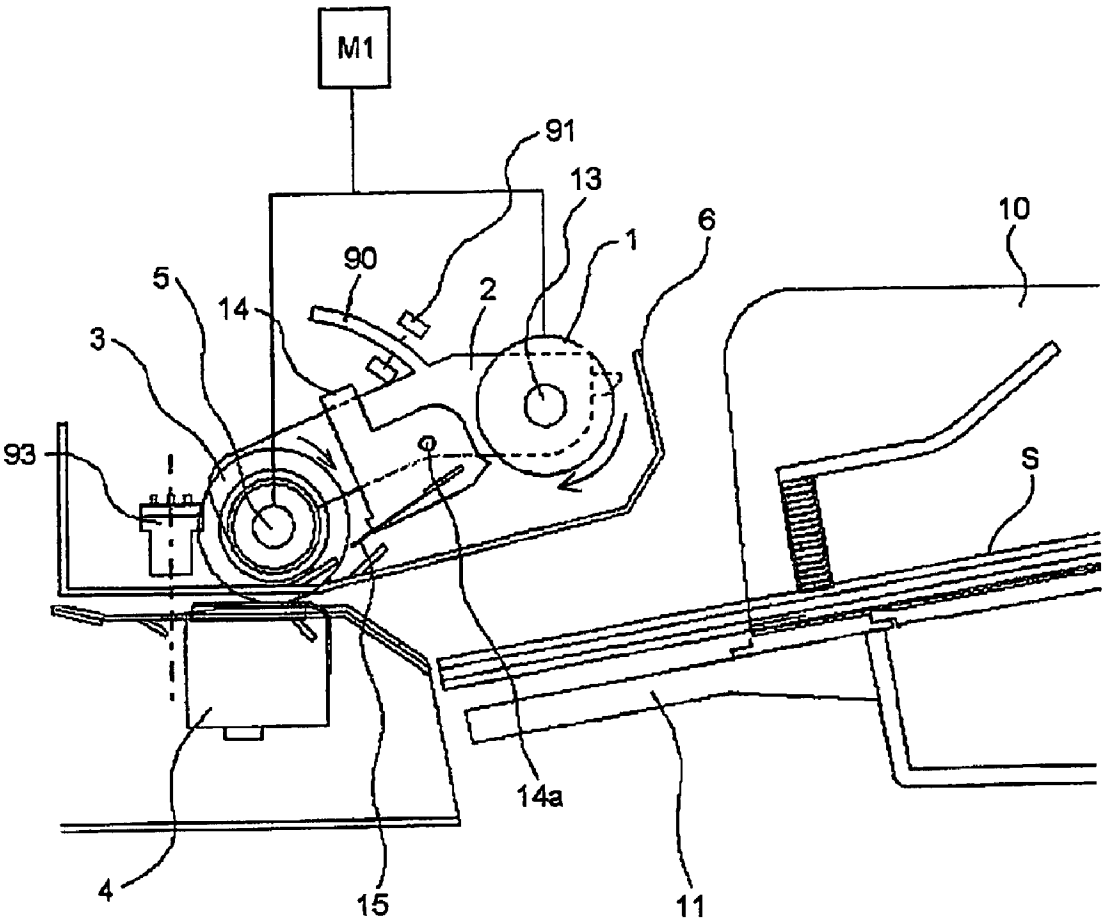
FIG. 3 is a view illustrating the configuration of an ADF provided in the image reading apparatus.

The feed roller 1 is turnably held (i.e., supported) via a shaft 13 on a side of a turn end of an arm 2 serving as a supporting member to be turned on a shaft 5, as illustrated in FIG. 3. With the turn of the arm 2, the feed roller 1 can be moved between an abutment position, at which it abuts against the original so as to feed the original S stacked on the original tray 11, and a separation position, at which it is separated from the original S stacked on the original tray 11. A sheet feeding portion for feeding the original includes the arm 2 and the feed roller 1 supported by the arm 2.

Here, the arm 2 includes an actuator 90 for a feed position detecting sensor 91 serving as a sheet position detecting portion for detecting whether or not the original tray 11 is lifted at a position at which the original can be fed. The feed position detecting sensor 91 is a sensor using a photo interrupter, to generate an ON signal when the actuator 90 shields an optical axis whereas to generate an OFF signal when the actuator 90 does not shield the optical axis. The feed position detecting sensor 91 is configured in such a manner as to generate a signal according to the position of the uppermost original stacked on the original tray 11. In other words, the feed position detecting sensor 91 generates the OFF signal indicating that the uppermost original stacked on the original tray 11 is located under the position at which the original can be fed, while it generates the ON signal indicating that the uppermost original stacked on the original tray 11 is located at the position at which the original can be fed.

Here, the feed position detecting sensor 91 is connected to a CPU circuit portion 1000 serving as a control portion illustrated in FIG. 5, described later, which is provided in the ADF 80, to thus control an original feeding operation of the ADF 80 and the lifting operation of the original tray 11.

Upon receipt of the ON signal in the CPU circuit portion 1000 from the feed position detecting sensor 91, the CPU circuit portion 1000 determines that the uppermost original stacked on the original tray 11 reaches the position at which the original can be fed. In contrast, in the state in which the optical axis is not shielded by the actuator 90, that is, upon receipt of the OFF signal in the CPU circuit portion 1000 from the feed position detecting sensor 91, the CPU circuit portion 1000 determines that the uppermost original stacked on the original tray 11 has not yet reached the position at which the original can be fed, and therefore, that the original cannot be fed, thereby lifting the original tray 11.

In FIG. 3, a stationary guide 6 is adapted to guide the original S from the feed roller 1 to the separation roller 3, and further, an oscillation guide 14 is interposed between the feed roller 1 and the separation roller 3 in such a manner as to be freely oscillated on a fulcrum 14*a*. An elastic member 15 made of Mylar or the like is attached to a tip downstream of the oscillation guide 14.

A feed sensor 93 serving as sheet detecting unit is provided downstream of the separation roller 3, for detecting the original fed by the feed roller 1. The feed sensor 93 is connected to the CPU circuit portion 1000, as illustrated later in FIG. 5. The CPU circuit portion 1000 determines whether or not the original is normally fed within a predetermined period of time in response to a detection signal output from the feed sensor 93.

Figure 4:
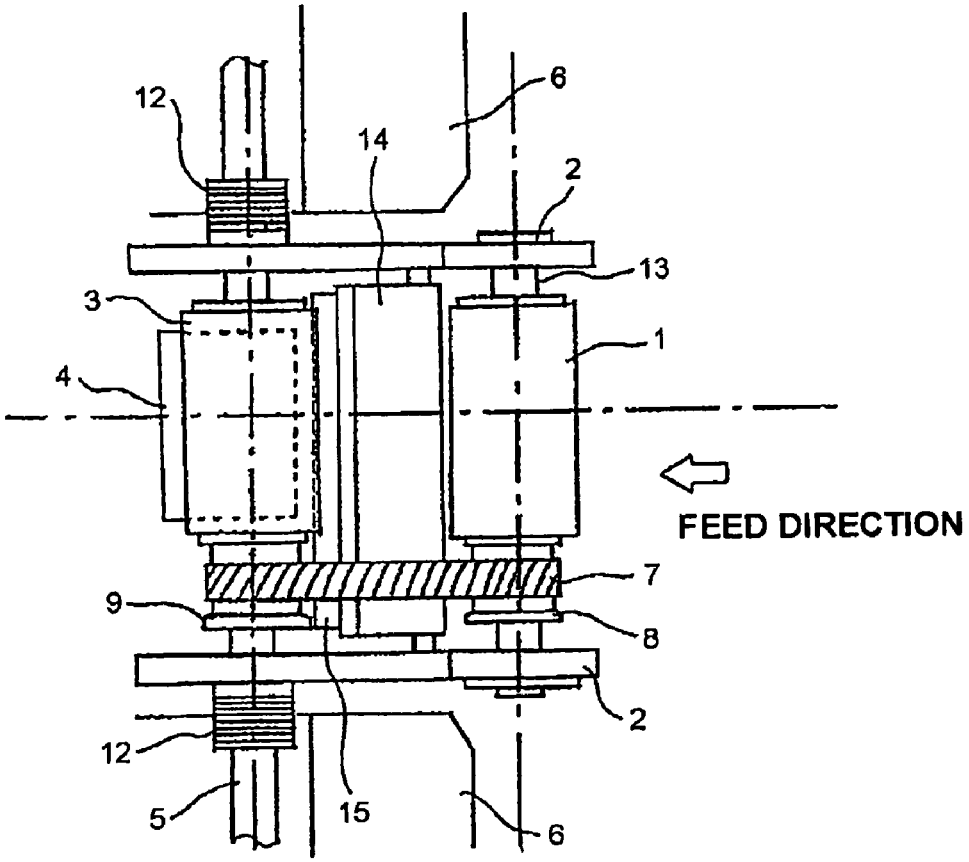
FIG. 4 is a view illustrating the configuration of a feeding portion in the ADF.

Here, the shaft 5 (or the feed roller 1) and the shaft 13 (or the separation roller 3) include pulleys 8 and 9, respectively, as illustrated in FIG. 4 which illustrates the configuration of the feeding portion of the ADF 80. A timing belt 7 is stretched across the pulleys 8 and 9. The shaft 5 is designed to be rotated by a drive motor M1 (see FIG. 3). Upon the rotation of the shaft 5, the rotation of the shaft 5 is transmitted to the pulley 9 and the pulley 8 via the timing belt 7, thereby rotating the feed roller 1 and the separation roller 3.

In the meantime, the shaft 5 includes a spring clutch 12 which urges the arm 2. During forward rotation of the drive motor M1, the feed roller 1 and the separation roller 3 are rotated in directions indicated by arrows, respectively, and further, the arm 2 is lowered, as illustrated in FIG. 3. After the feed roller 1 is landed on the upper surface of the original stacked on the original tray 11, a predetermined pressure (i.e., a predetermined torque) is applied to the original. In contrast, during reverse rotation of the drive motor M1, the feed roller 1 and the separation roller 3 are rotated reversely, and further, the arm 2 is locked by the spring clutch 12. And then, the arm 2 is lifted on the shaft 5, so that the feed roller 1 is separated from the original stacked on the original tray 11. Every time one piece of original is fed, the arm 2 makes a reciprocating motion between the abutment position, at which the feed roller 1 abuts against the uppermost original, and the separation position, at which the feed roller 1 is separated from the original.

Figure 5:
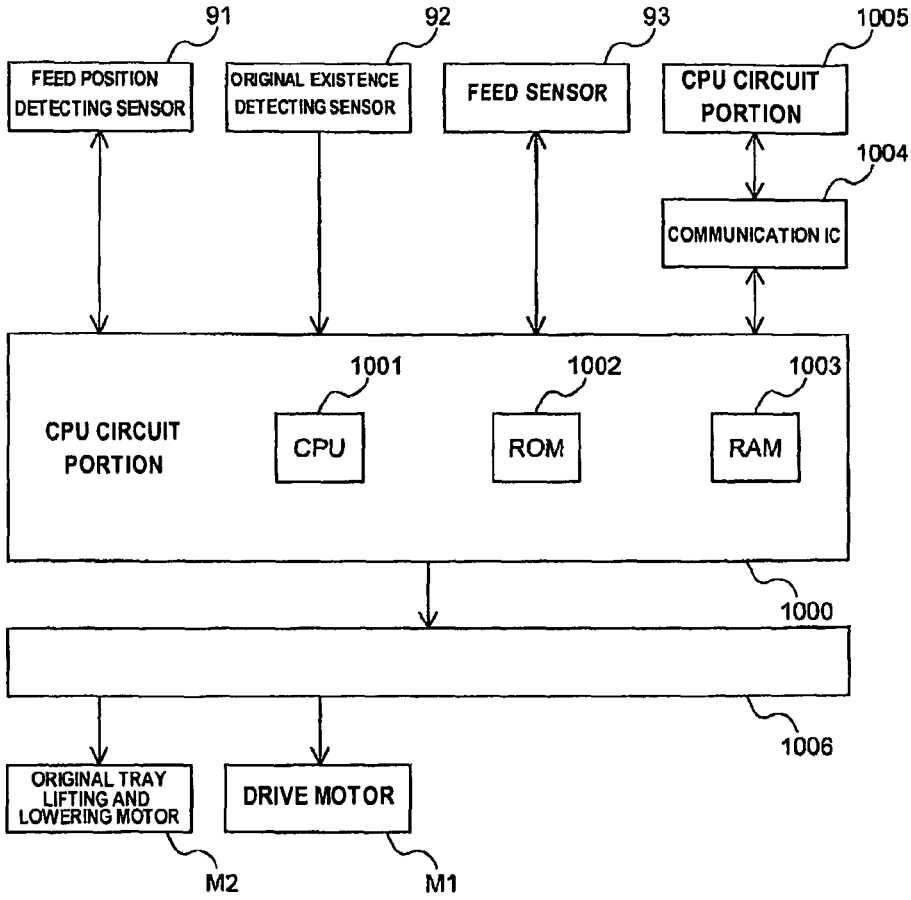
FIG. 5 is a control block diagram illustrating a control portion which controls the drive of the ADF.

FIG. 5 is a control block diagram illustrating the control portion which controls the drive of the ADF 80. The control portion of the ADF 80 includes the CPU circuit portion 1000 configured of a CPU 1001, a ROM 1002, and a RAM 1003. The CPU circuit portion 1000 communicates with a CPU circuit portion 1005 provided on the side of the image forming apparatus body via a communication IC 1004, to exchange data therewith. Moreover, the CPU circuit portion 1000 executes various kinds of programs stored in the ROM 1002 in response to an instruction output from the CPU circuit portion 1005, so as to control the drive of the ADF 80.

To the CPU circuit portion 1000 is connected a driver 1006, which drives various kinds of motors such as the original tray lifting and lowering motor M2 and the drive motor M1 which performs the lifting and lowering operation of the original tray 11 in response to a signal output from the CPU circuit portion 1000. Here, the drive motor M1 and the original tray lifting and lowering motor M2 are stepping motors which can rotate the pairs of rollers at constant speeds or their peculiar speeds by controlling an excitation pulse rate. In addition, the original tray lifting and lowering motor M2 and the drive motor M1 can be driven forward and reversely by the driver 1006.

Additionally, the CPU circuit portion 1000 receives detection signals from the feed position detecting sensor 91 and the feed sensor 93, which have been described already, and an original existence detecting sensor 92 which detects the existence of the original stacked on the original tray 11. The CPU circuit portion 1000 performs a driving control such as a lifting control of the original tray 11 in response to the detection signals output from these sensors 91 to 93.

Figure 6:
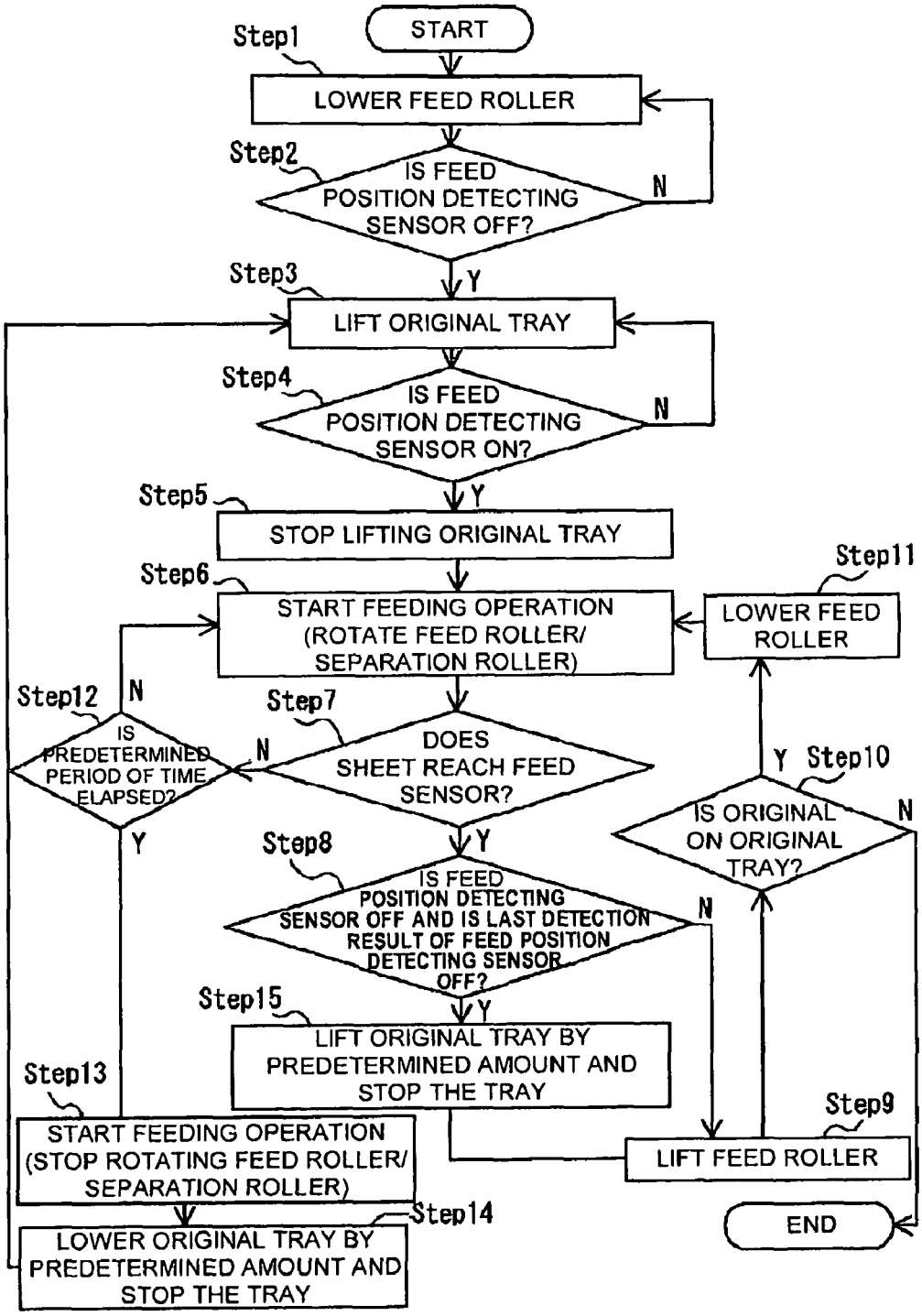
FIG. 6 is a flowchart illustrating an original feed controlling operation by the ADF.

Subsequently, a control operation of the ADF 80 such configured as described above will be described below with reference to a flowchart of FIG. 6.

First, when the original S is stacked on the original tray 11, the original existence detecting sensor 92 detects the original S, so that the ADF 80 comes into a state in which it can start operation (i.e., a standby state). Incidentally, the original tray 11 is located at a lowermost position which is referred to as an original set position, as illustrated in FIG. 3.

When, in this state, a start key, not illustrated, disposed on the side of the image forming apparatus body is depressed, a feed start signal is input into the CPU circuit portion 1000 from the CPU circuit portion 1005 equipped on the side of the image forming apparatus body, whereby the CPU circuit portion 1000 starts an initial operation for feeding the original and an original feeding operation.

Upon the depression of the start key, not illustrated, the CPU circuit portion 1000 first rotates the drive motor M1 forward for a predetermined period of time, so that the feed roller 1 is lowered together with the arm 2 on the shaft 5 (Step 1). And then, the CPU circuit portion 1000 continues to lower the feed roller 1 until the feed position detecting sensor 91 is turned OFF (N in Step 2).

Figure 7A:
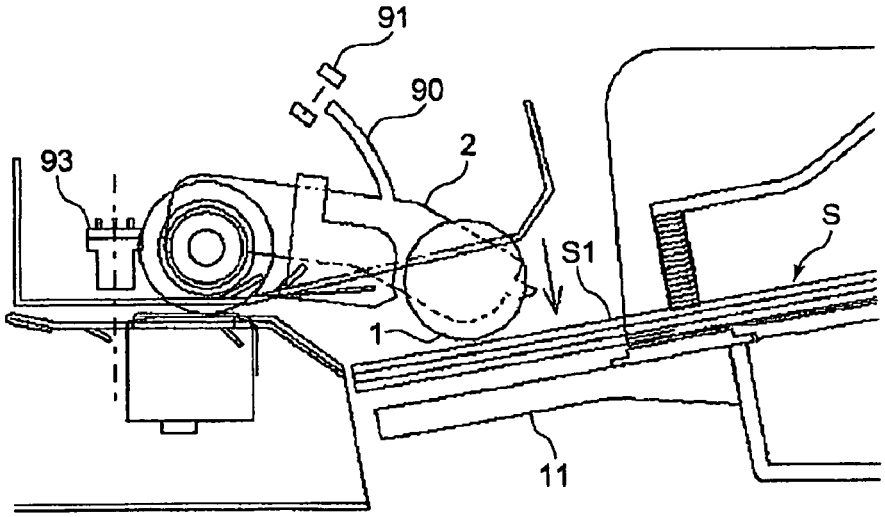
FIGS. 7A and 7B are first views illustrating an original feeding operation by the ADF.
Figure 7B:
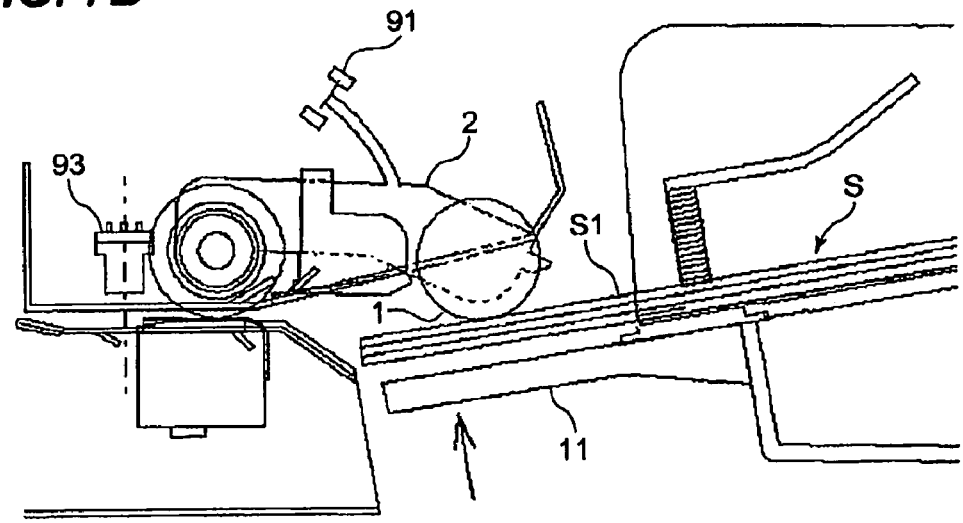

Thereafter, the CPU circuit portion 1000 lifts the original tray 11 from the lowermost position (Step 3). With the lift of the original tray 11, the feed roller 1 is brought into contact with (i.e., landed on) an uppermost original S1 stacked on the original tray 11, as illustrated in FIG. 7A. Here, when the CPU circuit portion 1000 controls the original tray lifting and lowering motor M2 in such a manner as to lift the original tray 11, the feed roller 1 in contact with the uppermost original S1 also is lifted. And then, the CPU circuit portion 1000 continues to lift the original tray 11 till reception of an ON signal output from the feed position detecting sensor 91 (N in Step 4), as illustrated in FIG. 7B.

Next, when the CPU circuit portion 1000 receives the ON signal output from the feed position detecting sensor 91 (Y in Step 4), that is, when the feed position detecting sensor 91 detects that the uppermost original S1 reaches the original feed position, the CPU circuit portion 1000 stops lifting the original tray 11 (Step 5).

The foregoing is referred to as the initial operation in which the original tray 11 located at the lowermost original set position is lifted up until the uppermost original reaches the original feed position. Thereafter, the CPU circuit portion 1000 performs the feeding operation, described below, to feed the originals one by one.

Specifically, the CPU circuit portion 1000 controls the drive motor M1 in such a manner as to rotate it forward, thereby rotating the feed roller 1 and the separation roller 3, so as to start the feeding operation (Step 6). As a consequence, the uppermost original S1 stacked on the original tray 11 is fed out, as illustrated in FIG. 8A.

Next, the CPU circuit portion 1000 confirms as to whether or not the original reaches the feed sensor 93 in response to a signal output from the feed sensor 93 disposed downstream in the vicinity of the separation roller 3 (Step 7).

And then, upon the confirmation of the reach of the original at the feed sensor 93 by the CPU circuit portion 1000 (Y in Step 7), the CPU circuit portion 1000 confirms as to whether or not OFF signal from the feed position detecting sensor 91 is received and whether or not memorized last signal from the feed position detecting sensor 91 is OFF signal (Step 8). In the Step 8, the CPU circuit portion 1000 confirms whether or not OFF signals are received in sequence a plurality of times from the feed position detecting sensor 91 in consideration of the memorized former detection result of the feed position detecting sensor 91.

Figure 8A:
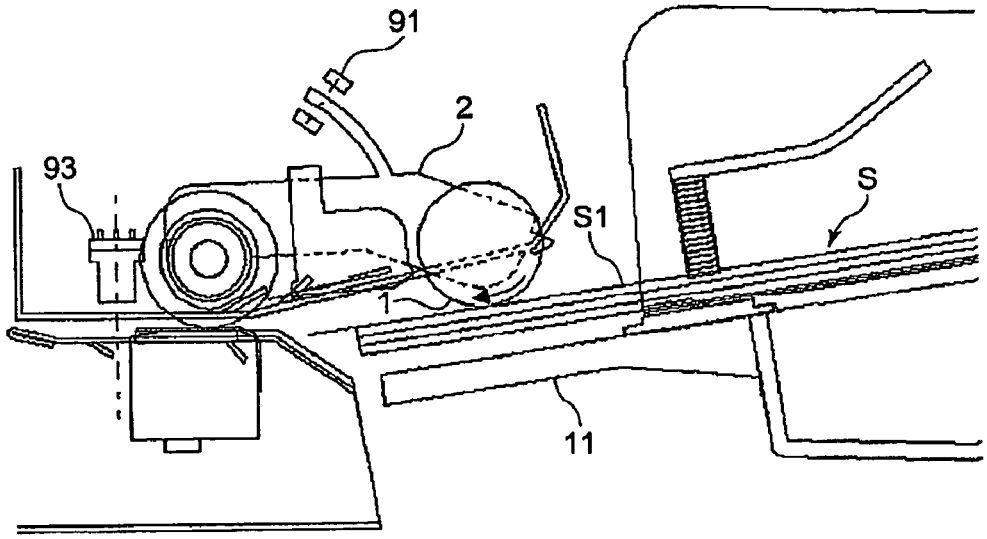
FIGS. 8A and 8B are second views illustrating the original feeding operation by the ADF.

Normally, since the plurality of originals S are stacked on the original tray 11 immediately after the feeding operation is started, the feed roller 1 is located at the original feed position illustrated in FIG. 8A, so that the ON signal is output from the original feed position detecting sensor 91. If the ON signal is output from the original feed position detecting sensor 91 (N in Step 8), the CPU circuit portion 1000 reversely rotates the drive motor M1 in such a manner as to prevent any exertion of a load on the fed original S1, thereby lifting the feed roller 1 (Step 9).

The above-described present embodiment is designed such that the feed roller 1 is lifted every time one piece of original is fed in such a manner as to prevent any exertion of the load on the fed original S1, to be thus moved to the separation position. If the original existence detecting sensor 92 detects that the original S is stacked on the original tray 11 (Y in Step 10), then, the feed roller 1 is lowered in order to feed the subsequent original (Step 11). Here, the control routine returns to Step 6, and then, the feeding operation is continued. In contrast, if it is determined that there is no original S on the original tray 11 in response to the signal output from the original existence detecting sensor 92 (N in Step 10), the CPU circuit portion 1000 finishes the feeding operation, and then, moves the original tray 11 to the lowermost original set position.

Figure 8B:
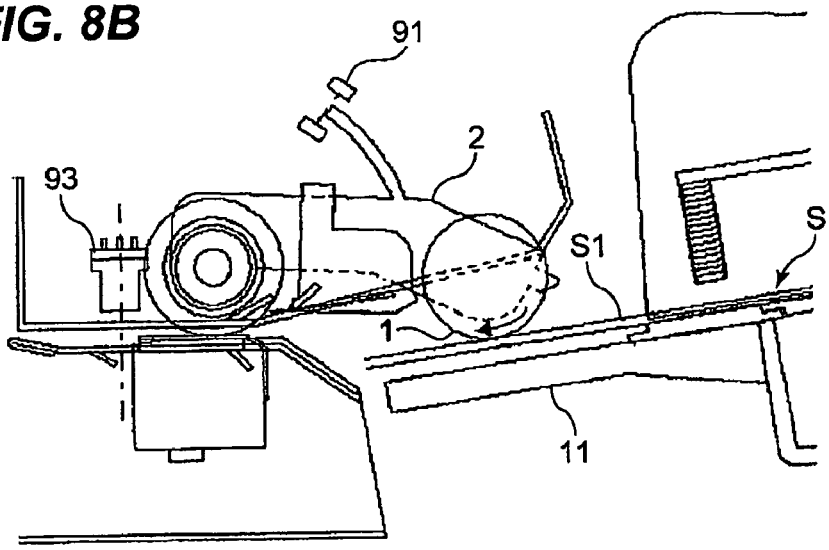
Figure 9:
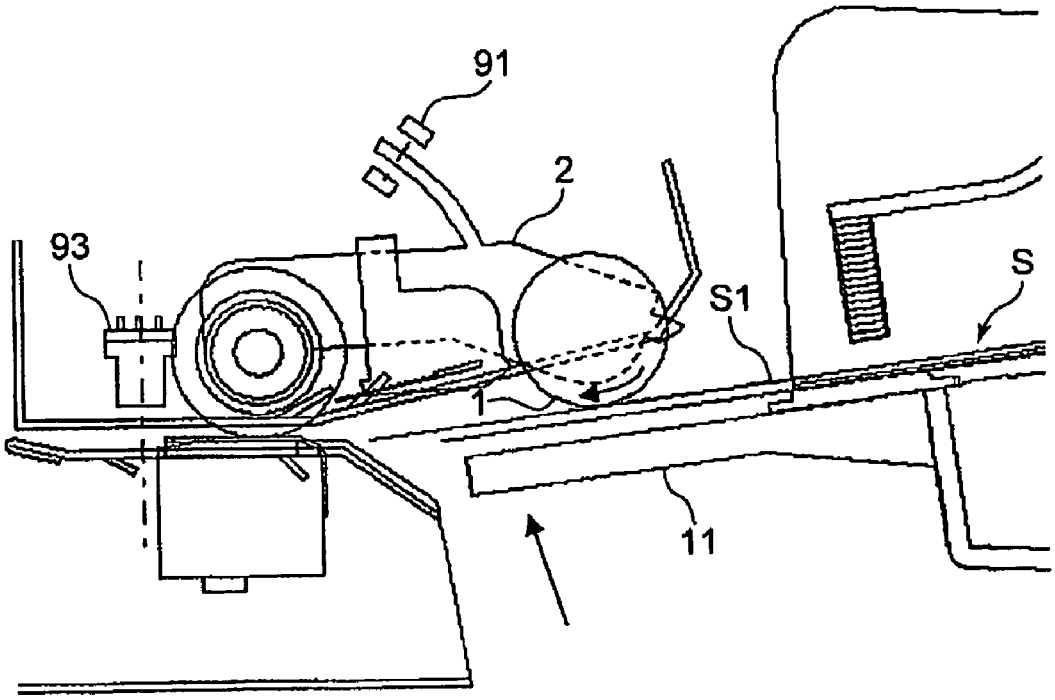
FIG. 9 is a third view illustrating the original feeding operation by the ADF.

When the feeding operation is continued to sequentially feed the originals S stacked on the original tray 11, the number of originals S stacked on the original tray 11 is reduced. Accordingly, the feed roller 1 is lowered, and then, the OFF signal is generated from the feed position detecting sensor 91, as illustrated in FIG. 8B. In the case where the OFF signal is generated from the feed position detecting sensor 91 in the above-described manner, the CPU circuit portion 1000 drives the lifting and lowering motor M2 by a predetermined amount in such a manner that the original tray 11 is lifted by a predetermined amount such that the uppermost original S1 reaches the original feed position (Step 15), as illustrated in FIG. 9. In the present embodiment, the CPU circuit portion 1000 drives the lifting and lowering motor M2, or a pulse motor, by a predetermined step in driving the lifting and lowering motor M2 by the predetermined amount. Here, the CPU circuit portion 1000 may controllably drive the lifting and lowering motor M2 only for the predetermined period of time, to thus drive the lifting and lowering motor M2 by the predetermined amount.

The feed position detecting sensor 91 may perform erroneous detection accidentally by an influence such as vibrations of the ADF 80 and deformation of the feed roller 1, to generate the OFF signal, although the original can be fed. In this case, the original tray 11 is lifted, although the original can be fed, so that not only unnecessary operation may be performed but also the uppermost original may be located too highly, thereby inducing deficient feeding. In view of this, in the present embodiment, the CPU circuit portion 1000 does not lift the original tray 11 when it receives the OFF signal from the feed position detecting sensor 91 only once. In the case where the CPU circuit portion 1000 sequentially receives the OFF signals a plurality of times, for example, two times from the feed position detecting sensor 91, it lifts the original tray 11. It can be formed that in the case where the CPU circuit portion 1000 sequentially receives the OFF signals three times from the feed position detecting sensor 91, it lifts the original tray 11. Incidentally, in the present embodiment, the feed position detecting sensor 91 detects the position of the arm 2. Therefore, the feed position detecting sensor 91 may possibly perform the erroneous detection caused by the vibrations of the arm 2.

In view of this, even if the feed position detecting sensor 91 is turned OFF in Step 8 already described, the feed roller 1 is lifted (Step 9) in the case of the first OFF (N in Step 8), thereby continuing the feeding operation. As described already, even if the feed position detecting sensor 91 is turned OFF, about two pieces of originals can be fed, and therefore, the feeding operation may be continued to feed the original. Here, in the case where the feed position detecting sensor 91 is turned OFF by the influence such as the vibrations of the ADF 80, thereafter, the feeding operation can be continued since the CPU circuit portion 1000 cannot receive the OFF signals sequentially two times.

In contrast, in the case where the uppermost original stacked on the original tray 11 is located under the position at which the original can be fed, the feed position detecting sensor 91 is turned OFF every time the original is fed. The number of times in which the feed position detecting sensor 91 is turned OFF is stored in the RAM 1003 (see FIG. 5).

In the case where the CPU circuit portion 1000 receives the OFF signals sequentially two times from the feed position detecting sensor 91 (Y in Step 8), the CPU circuit portion 1000 determines that the uppermost original is located under the original feed position, thus lifting the original tray 11 by the predetermined amount, so as to stop it there (Step 15). The CPU circuit portion 1000 lifts the original tray 11 by the predetermined amount, before the CPU circuit portion 1000 lifts the feed roller 1 (Step 9). Consequently, the feeding operation can be continued.

In other words, when the arm 2 is located at the feed position at which the feed roller 1 is lowered to be thus brought into contact with the uppermost original, the CPU circuit portion 1000 checks the signal output from the feed position detecting sensor 91. The feed roller 1 is repeatedly lifted or lowered every time one piece of original is fed. The CPU circuit portion 1000 checks the signal output from the feed position detecting sensor 91 when the arm 2 is located at the feed position at which the feed roller 1 is brought into contact with the original. As a consequence, the CPU circuit portion 1000 checks the signal output from the feed position detecting sensor 91 every time the feed roller 1 feeds one piece of original. In Step 7, the CPU circuit portion 1000 determines whether or not it sequentially receives the OFF signals the plurality of times from the feed position detecting sensor 91 based on the previous signal output from the feed position detecting sensor 91 stored in the RAM 1003 and the current output from the feed position detecting sensor 91. That is to say, during the feeding operation, the CPU circuit portion 1000 does not determine that the uppermost original is lowered beyond the feed position until it receives the OFF signal from the feed position detecting sensor 91 sequentially times corresponding to the plurality of originals at a timing when the feed roller 1 is lowered.

As described above, in the present embodiment, the detection whether or not the uppermost original is located under the original feed position is performed during the feeding operation by the feed roller 1 and every feeding of the original. Moreover, the CPU circuit portion 1000 does not determine that the uppermost original is located under the original feed position only upon one reception of the signal indicating that the uppermost original is located under the original feed position from the feed position detecting sensor 91, but the CPU circuit portion 1000 lifts the original tray 11 by the predetermined amount in the case where the CPU circuit portion 1000 receives sequentially the plurality of times the signals indicating that the uppermost original is located under the original feed position.

With this configuration, it is possible to prevent any generation of the lifting operation of the original tray 11 due to the erroneous detection by the feed position detecting sensor 91, thereby suppressing noise or power consumption accordingly.

In the case where the feed position detecting sensor 91 cannot detect the original stacked on the original tray 11 by the influence caused by the vibrations of the ADF 80, the original tray 11 may be excessively lifted, and accordingly, the feed roller 1 also may be located above the predetermined feed position. If the feed roller 1 is located above the predetermined feed position, the original may not be fed in press-contact with the feed roller 1.

If the original cannot be fed in the above-described case, the feed sensor 93 does not detect the reach of the original (N in Step 7). In this state, if a predetermined period of time is elapsed (Y in Step 12), the CPU circuit portion 1000 determines that the position of the original tray 11 is too high. In other words, if the feed sensor 93 does not detect the reach of the original for a given period of time after the start of the feeding operation in which the feed roller 1 is started to be rotated, the CPU circuit portion 1000 determines that the position of the original tray 11 is too high.

In the case where the CPU circuit portion 1000 determines so, it stops rotating the feed roller 1 and the separation roller 3, thereby temporarily stopping the feeding operation (Step 13). Thereafter, the CPU circuit portion 1000 lowers the original tray 11 by the predetermined amount in such a manner as to release the press-contact of the original with the feed roller 1 (Step 14). And then, the control routine return to Step 3, in which the CPU circuit portion 1000 lifts the original tray 11 again, thus restarting the feeding operation.

In this manner, in the present embodiment, in the case where the feed sensor 93 does not detect the reach of the original for the predetermined period of time, the feeding operation is stopped. Specifically, in the present embodiment, the feeding operation is stopped only when the feed sensor 93 does not detect the reach of the original for the predetermined period of time. With this configuration, it is possible to reduce the times in which the feeding operation is stopped, thus suppressing any significant degradation of productivity.

As described above, in the present embodiment, when it is detected sequentially the plurality of times that the uppermost original does not reach the feed position after the original is started to be fed, the original tray 11 is lifted. Consequently, it is possible to achieve the feeding operation while constantly keeping the feed position without any unnecessary lifting operation of the original tray 11.

Additionally, only in the case where the feed sensor 93 does not detect the reach of the original for the predetermined period of time, the feeding operation is stopped. As a consequence, it is possible to reduce the number of times in which the feeding operation is stopped, thus suppressing any significant degradation of productivity.

In above described embodiment, in the case where the CPU circuit portion 1000 sequentially receives the OFF signals a plurality of times, it lifts the original tray 11. But it can be formed that in the case where the CPU circuit portion 1000 receives the OFF signals a plurality of times after it lifts the original tray 11, it lifts the original tray 11.

Although the description has been given of the mode in which the sheet feeding apparatus according to the present invention is applied to the ADF 80, the present invention is not limited to this. For example, the sheet feeding apparatus according to the present invention may be applied to the image forming apparatus body or a composite machine including the image reading apparatus and the image forming apparatus in combination, thereby producing a similar effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-058497, filed Mar. 7, 2008, which is hereby incorporated by reference herein in its entirety.

What is claimed is:

1. The sheet feeding apparatus comprising:

a liftable stacking member on which a sheet is stacked;

a feeding member which feeds the sheet in abutment against the uppermost one of the sheets placed on the stacking member, wherein the feeding member moves from a separation position, at which the feeding member is separated from the uppermost one of the sheets placed on the stacking member, to an abutment position at which the feeding member abuts against the uppermost one of the sheets placed on the stacking member, and after the feeding member feed the uppermost one of the sheets placed on the stacking member, the feeding member moves from the abutment position to the separation position;

a driving portion which lifts the stacking member;

a sensor which generates a signal indicating the uppermost one of the sheets that the feeding member abuts against is below a predetermined position; and a control portion configured to control the driving portion so as to lift the stacking member when the signal is received in sequence a plurality of times, which the control portion receives from the sensor due to the feeding member moving from the separation position to the abutment position repeatedly, indicate that the uppermost one of the sheets placed on the stacking member is located below a predetermined position.

2. The sheet feeding apparatus according to claim 1, wherein the control portion controls the driving portion so as to lift the stacking member when the control portion receives from the sensor the plurality of signals indicating that the uppermost one of the sheets placed on the stacking member is located below the predetermined position as sequential signals every time the feeding member moves from the abutment position to the separation position.

3. The sheet feeding apparatus according to claim 1, further comprising:

a separating portion configured to separate sheet fed by the feeding portion one by one;

a sheet detecting unit configured to detect the sheet which has been separated by the separating portion, wherein the control portion receives the signal from the sensor responding to detection of the sheet detecting unit.

4. The sheet feeding apparatus according to claim 1, further comprising:

a movable supporting member configured to support the feeding member, wherein the sensor generates the signal by detecting a position of the supporting member.

5. The sheet feeding apparatus according to claim 1, wherein the driving portion includes a motor which generates driving force for lifting the stacking member, and the control portion drives the motor by a predetermined amount in such a manner as to lift the stacking member by receiving the plurality of signals indicating that the uppermost one of the sheets placed on the stacking member is located below the predetermined position.

6. The sheet feeding apparatus according to claim 1, further comprising:

a sheet detecting unit which detects the sheet which has fed by the feeding member, wherein the control portion controls the driving portion in such a manner as to lower the stacking member when the sheet detecting unit does not detect the sheet which has been fed by the feeding member a predetermined time period after the feeding member starts to feed the sheet.

7. An image reading apparatus comprising:

an image reading portion which reads image information on the sheet; and the sheet feeding apparatus according to claim 1 which feeds the sheet to an image read position at which by the image reading portion reads the image information on the sheet.

* * * * *